United States Patent [19]

Bock

[11] 4,327,913

[45] May 4, 1982

[54] BASEBALL GAME APPARATUS

[76] Inventor: George E. Bock, P.O. Box 17958, Fountain Hills, Ariz. 85268

[21] Appl. No.: 198,940

[22] Filed: Oct. 20, 1980

[51] Int. Cl.[3] ..... A63F 7/14; A63F 7/06

[52] U.S. Cl. ..... 273/89; 273/26 D; 124/17; 124/36; 124/41 R; 124/81

[58] Field of Search ..... 273/89, 26 D; 124/41 R, 124/81, 16, 17, 36

[56] References Cited

U.S. PATENT DOCUMENTS

| | | | |
|---|---|---|---|
| 591,794 | 10/1897 | Andriot | 273/89 |
| 1,060,846 | 5/1913 | Krumeich | 273/89 |
| 1,703,009 | 2/1929 | Kiesling | 273/89 |
| 2,161,129 | 6/1939 | Brook | 273/89 |
| 2,276,457 | 3/1942 | Bock | 273/89 |
| 3,009,451 | 11/1961 | Zone | 273/89 X |
| 3,706,454 | 12/1972 | Parlato | 273/89 |
| 4,004,567 | 1/1977 | Henerson | 124/41 R X |

*Primary Examiner*—George J. Marlo
*Attorney, Agent, or Firm*—Cahill, Sutton & Thomas

[57] ABSTRACT

A baseball game apparatus includes a pitching mechanism including an upwardly inclined slotted track extending above the playing surface for pitching a ball in a lofted trajectory toward home plate, the angle of inclination being variable to adjust the loft of pitched balls. The pitching mechanism is adapted to receive a plurality of interchangeable pitching arms for varying the characteristics of the pitching mechanism. Each pitching arm includes one or more variously angled surfaces for controlling the trajectory of the pitched ball. A rotatable batting member is disposed adjacent home plate and includes a control lever disposed below the playing surface, and a depressible bunt control mechanism selectively engages the control lever for stopping the rotatable batting member generally over home plate to bunt a pitched ball. A strike zone deflector having dimensions commensurate with the strike zone above home plate is positioned behind home plate for impacting pitched balls which have passed through the strike zone of the batting member and deflecting the same through the aperture within the playing surface.

8 Claims, 13 Drawing Figures

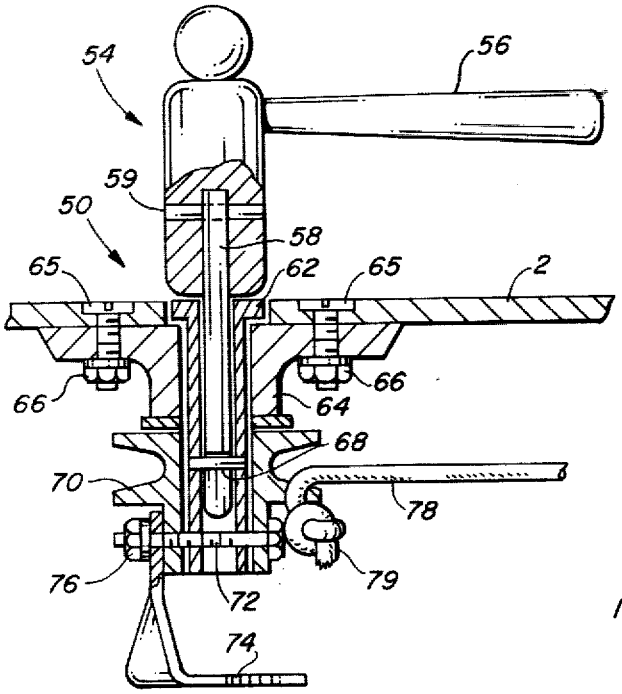
FIG. 3
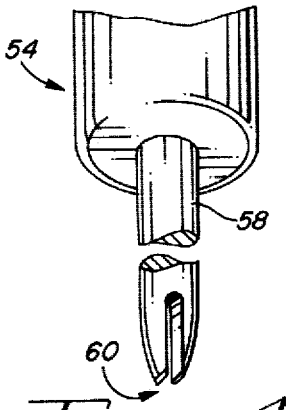
FIG. 4
FIG. 7
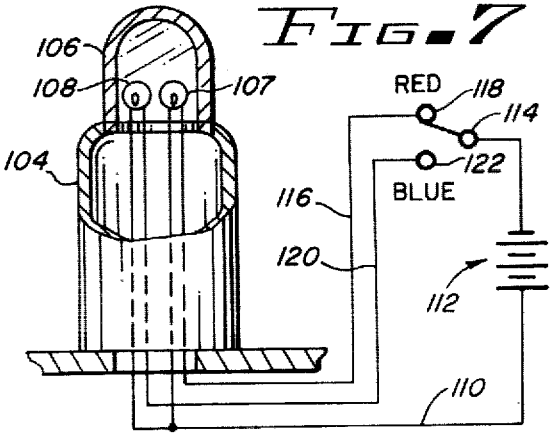
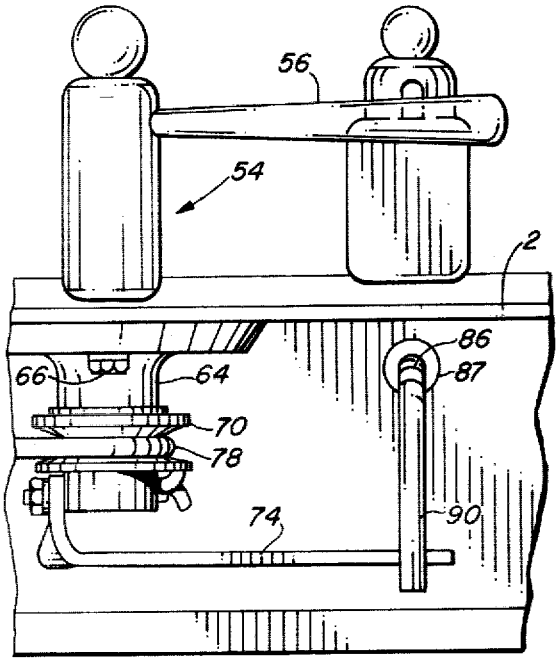
FIG. 5
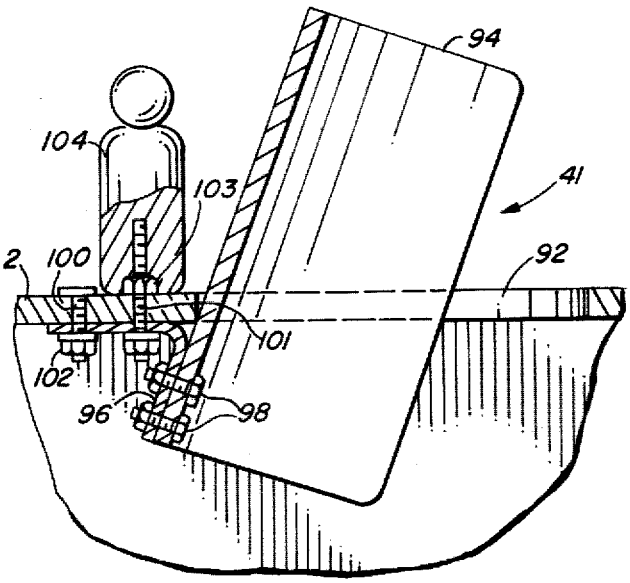
FIG. 6

FIG. 8
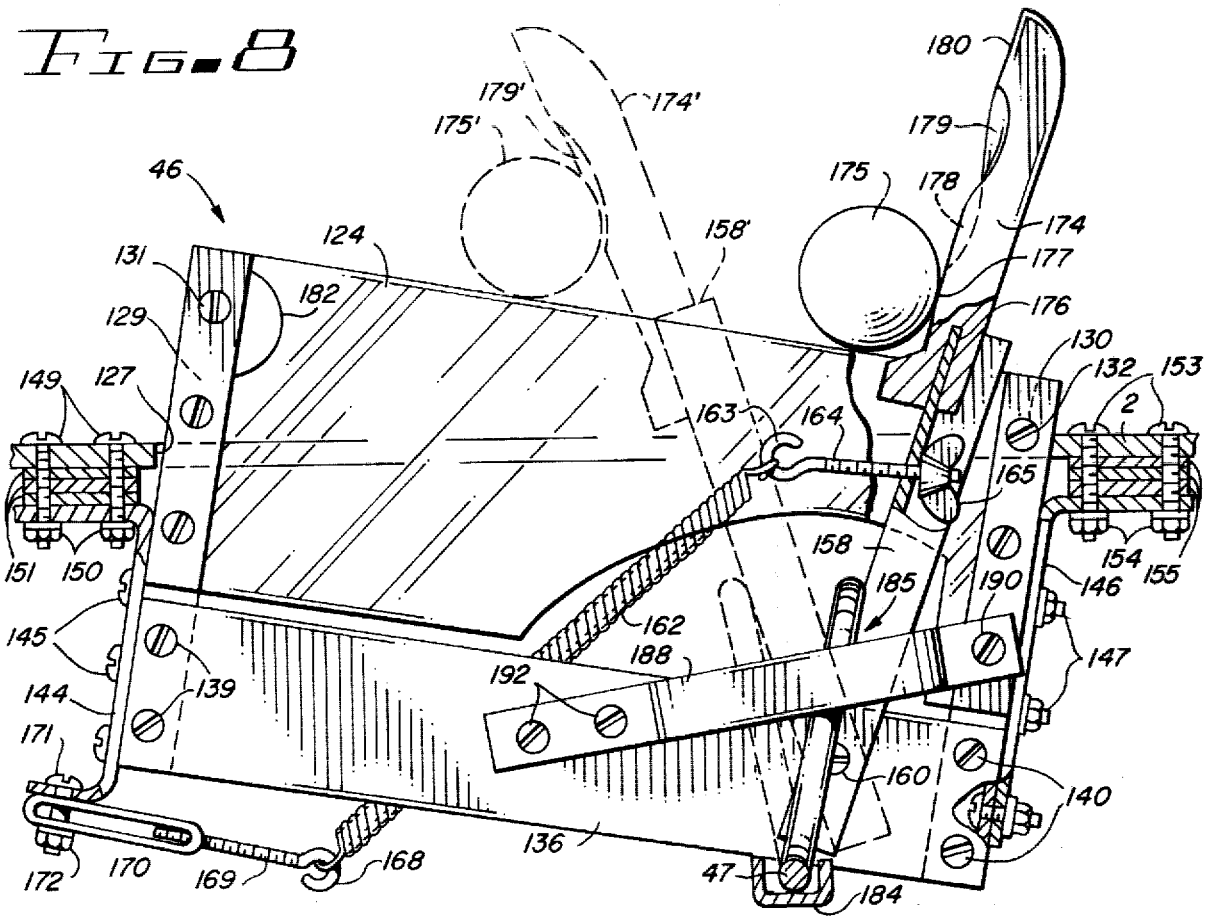
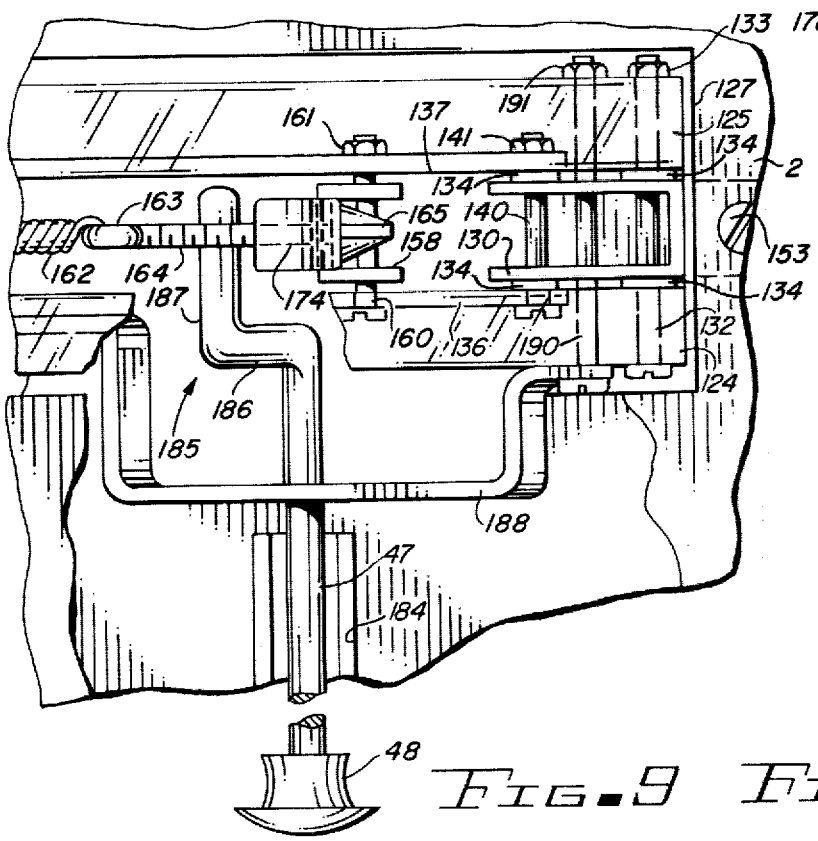
FIG. 9
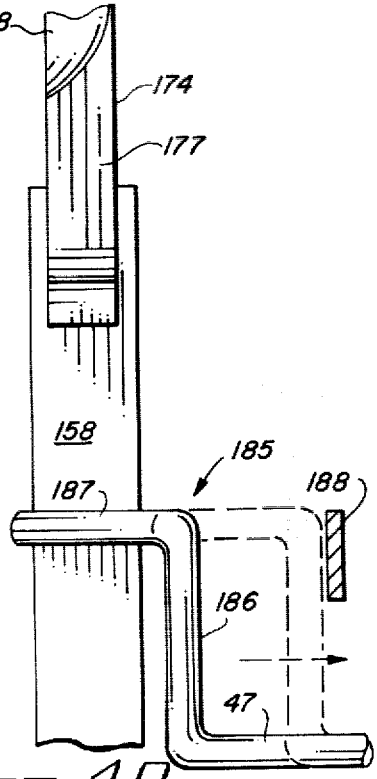
FIG. 10

BASEBALL GAME APPARATUS

BACKGROUND OF THE INVENTION

1. Field of the Invention

The present invention relates generally to a game apparatus, and more particularly, to an indoor baseball game apparatus which closely simulates the actual game of baseball.

2. Description of the Prior Art

Baseball game apparatus of the type wherein a ball is propelled across a playing board toward a batting mechanism is known in the art. For example, U.S. Pat. No. 2,276,457, entitled "BASEBALL GAME APPARATUS" and issued to the inventor of the present invention, discloses an apparatus wherein a ball is propelled across the playing board from a pitching mechanism toward a batting mechanism. However, the degree to which such an apparatus can simulate actual baseball is limited since the ball is rolled across the playing board rather than being pitched into the air.

Baseball game apparatus of the type wherein a pitching mechanism pitches the ball in a lofted trajectory above the game board is also known in the art. For example, U.S. Pat. Nos. 2,534,468 and 3,834,703 each disclose baseball game apparatus including a pitching mechanism having a rotatable pitching arm for propelling the ball through the air in the direction of the batter. The pitching mechanism disclosed in U.S. Pat. No. 2,534,468 is secured in a fixed position upon the playing board, and hence the direction in which the ball is pitched may not be varied. The pitching mechanism disclosed in U.S. Pat. No. 3,834,703 includes a positioning rod used to stabilize the pitching mechanism and to control the degree of tilt of the pitching mechanism, thereby controlling the arc of the pitched ball. The positioning rod is also used to control the direction of the pitched ball. In addition to the positioning rod, a pressure rod must alsobe operated by a participant in order to actuate a release rod for propelling the ball toward the batter. Controlling the disclosed pitching mechanism is somewhat complex and inconvenient because a participant must use both of his hands to operate the pitching mechanism. Moreover, the positioning rod and release rod extend over a substantial length of the playing board and can interfere with batted balls as well as detract from the appearance of the playing board.

In addition, none of the above described prior art pitching mechanisms is adapted to accommodate participants having varying levels of skill. Prior art pitching mechanisms having relatively simple controls are easily operated by a beginner but lack the sophistication desired by an experienced player. On the other hand, pitching mechanisms having more complex controls often confuse the beginner and detract from enjoyment of the game.

In the actual game of baseball, an umpire is positioned behind home plate for determining, in cases where the batter does not swing at a pitched ball, whether the pitched ball counts as a ball or a strike against the batter. A pitched ball counts as a strike if it passes over home plate while passing above the batter's knees and below his shoulders, i.e., through the strike zone. In order to simulate the actual game of baseball, it is desirable for a baseball game apparatus to include a mechanism for distinguishing balls from strikes.

In U.S. Pat. No. 3,834,703, a baseball game apparatus is disclosed wherein a catching device establishes a strike zone by retaining only those pitched balls that have passed within the hitting range of the batter. However, pitched balls which barely miss passing through the hitting zone of the batter tend to impact the top, bottom, and side portions of the disclosed catching device; in such instances, the ball is likely to rebound back into fair territory on the playing board and be mistaken for a battered ball if the batter swings at the ball and misses it. In addition, the disclosed catching device tends to be relatively large and detracts from the appearance of the apparatus. Further, the disclosed catching device poses an inconvenience to the participant responsible for retrieving pitched balls since the point from which a pitched ball must be retrieved depends upon whether or not it has passed through the strike zone and hence, whether or not it has been retained by the catching device.

In prior art baseball game apparatus, the batting mechanism typically includes a rotatable batting member and a spring or similar biasing means for causing the batting member to rotate after it has been released from a cocked position. Thus, releasing the batting member from its cocked position results in a full swing at the pitched ball. In the actual game of baseball, however, a batter may hit the ball by holding the bat relatively motionless above home plate in order to bunt the ball into the infield. Known baseball game apparatus do not conveniently allow participants to bunt a pitched ball and therefore fail to simulate this aspect of the actual game of baseball.

Accordingly, it is an object of the present invention to provide a baseball game apparatus having a pitching mechanism for pitching the ball in a lofted trajectory above the playing board and wherein the speed and direction of the pitched ball may easily be controlled.

It is another object of the present invention to provide a baseball game apparatus having a pitching mechanism which conveniently accommodates participants having widely different levels of skill.

It is still another object of the present invention to provide a baseball game apparatus having a pitching mechanism for pitching a ball in a lofted trajectory above the playing board wherein the characteristics of the pitching mechanism can be quickly and conveniently altered to simulate the different pitching styles of a number of different pitchers on a baseball team.

It is a further object of the present invention to provide a baseball game apparatus having a pitching mechanism for pitching a ball in a lofted trajectory and a batting mechanism for hitting pitched ball and including a mechanism for indicating whether pitched balls have passed through the batter's strike zone while directing both balls and strikes to a common retrieval point.

It is still a further object of the present invention to provide a basbeall game apparatus having a rotatable batting member adapted to hit a pitched ball with a full swing and including a mechanism for selectively causing the batting member to bunt a pitched ball rather than hitting the pitched ball with a full swing.

These and other objects of the present invention will become apparent to those skilled in the art as the description thereof proceeds.

SUMMARY OF THE INVENTION

Briefly described, and in accordance with one embodiment thereof, the present invention relates to a baseball game apparatus having a pitching mechanism including a slotted track extending above the playing board, a pitching member pivotally mounted for movement within the slotted track, and a biasing member for urging the pitching member toward the front end of the slotted track. The slotted track is preferably inclined with the front end being higher than the back end. The ball is received by the slotted track and is propelled by the pitching member in a lofted trajectory above the playing board.

The pitching member ideally includes a pivotally mounted lower portion or pivot member and one or more upper portions or pitching arms which removably engage the pivot member. Each pitching arm preferably has a plurality of variously angled surfaces formed thereon for varying the speed and trajectory of the pitched ball. A release mechanism controls the release of the pivot member and thereby determines which of the surfaces formed on the pitching arm contacts the ball for propelling it toward home plate.

Another aspect of the present invention relates to a strike zone deflector for use in conjunction with a baseball game apparatus having pitching and batting mechanisms wherein the strike zone deflector indicates whether pitched balls have passed through the batter's strike zone. An aperture is formed within the playing board behind home plate and a shield is mounted to the playing board behind the aperture for deflecting pitched balls into the aperture. The strike zone deflector is disposed above the aperture and between the shield and home plate. Pitched balls which pass through the hitting range of the batter impact the strike zone deflector prior to reaching the shield and are thereby deflected into the aperture.

Still another aspect of the present invention relates to a baseball game apparatus having a rotatably mounted batting member, a biasing member for rotating the batting member upon release from a cocked position, and a mechanism for selectively stopping the rotation of the batting member after release from the cocked position but prior to completion of a full swing in order to effect a bunt. Preferably, the mechanism for stopping rotation of the batting member can be controlled to vary the point at which rotation is stopped and, hence, the direction in which the ball is bunted.

BRIEF DESCRIPTION OF THE DRAWINGS

FIG. 3 is a cross-sectional view of the batting mechanism.

FIG. 4 is a perspective view of the bottom portion of a removable batting member.

FIG. 5 is a frontal view of the batting mechanism in engagement with the bunt control mechanism.

FIG. 6 is a cross-sectional view of a fielding aperture.

FIG. 7 is a schematic illustration of electrical circuitry which may be utilized to identify the team playing the field.

FIG. 8 is a side view of a pitching mechanism constructed according to the teachings of the present invention.

FIG. 9 is a partial top view of the pitching mechanism shown in FIG. 8.

FIG. 10 is a frontal view of a pitching member and a release rod used to control the pitching member.

DETAILED DESCRIPTION OF THE PREFERRED EMBODIMENT

Figure 1:
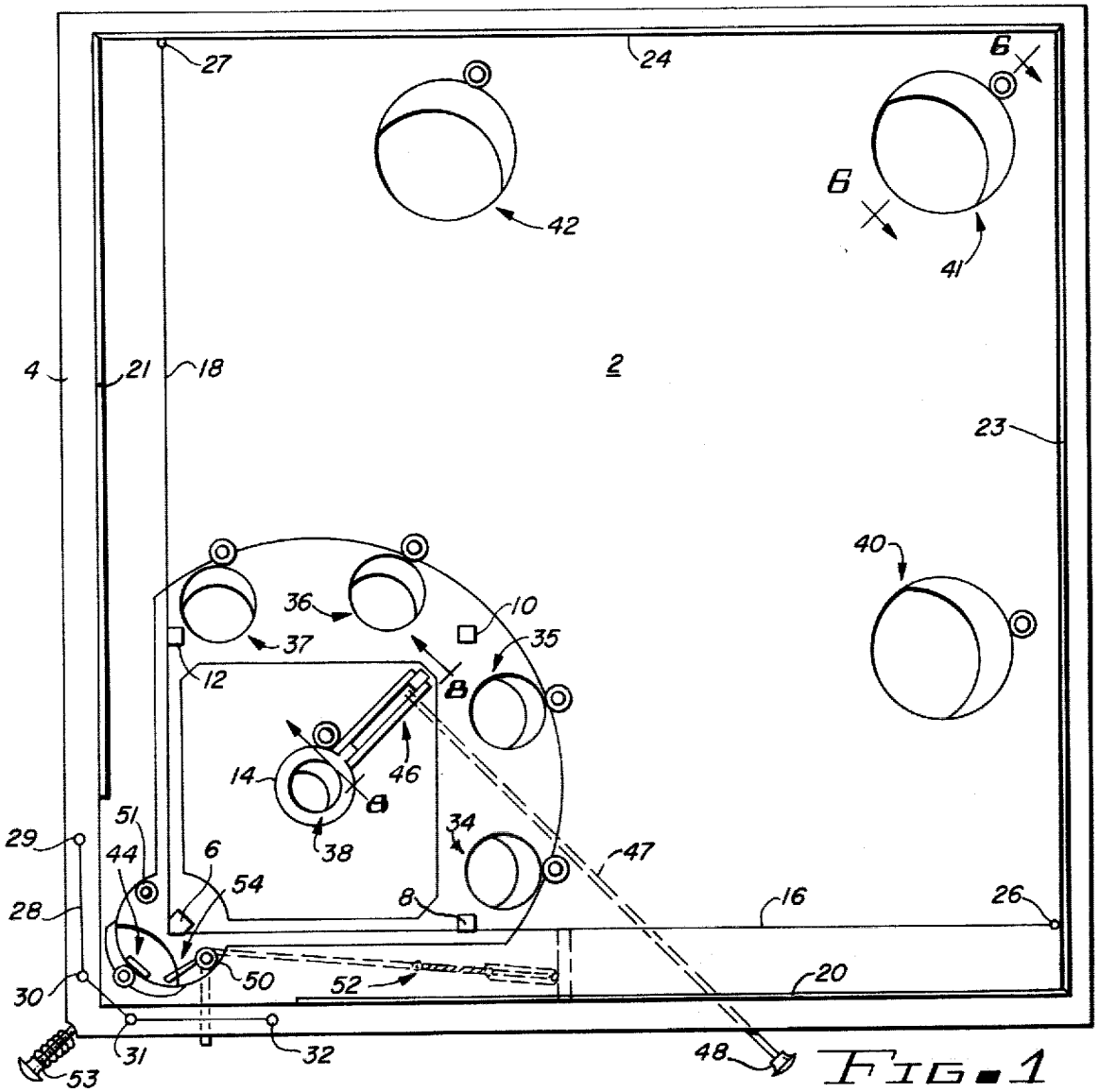
FIG. 1 is a top view of a playing board for a baseball game apparatus according to the teachings of the present invention.

As shown in FIG. 1, the baseball game apparatus includes a playing field board 2 enclosed within an outer frame 4. A baseball diamond is formed upon playing board 2, including home plate 6, first base 8, second base 10 and third base 12. Pitcher's mound 14 is located in the center of the diamond. Right field foul line 16 and left field foul line 18 extend from home plate to the right field fence 23 and left field fence 24, respectively. Fences 20 and 21 are disposed along right and left foul territories, respectively, for deflecting balls that are batted into foul territory. Foul pole 26 extends vertically from playing board 2 at the point at which foul line 16 intersects right field fence 23. Similarly, foul pole 27 extends vertically from playing board 2 at the point at which foul line 18 intersects left field fence 24. Positioned behind home plate 6 is a backstop 28 formed of netting and extending between vertical supports 29, 30, 31 and 32.

Disposed within the infield of playing board 2 are fielding apertures 34, 35, 36 and 37, corresponding to the fielding positions assumed by the first baseman, second baseman, shortstop, and third baseman in the actual game of baseball. An additional fielding aperture 38 is disposed within pitcher's mound 14. Somewhat larger fielding apertures 40, 41 and 42 are formed in the right field, center field, and left field portions, respectively, of playing board 2. The construction of each of the fielding apertures is described in further detail below with regard to FIG. 6. A catcher, designated generally by reference numeral 44, is positioned behind home plate 6 and incorporates a strike zone deflector described in further detail below. Although not shown in the Figures, one or more inclined planes are disposed below playing board 2 for causing balls deflected into the fielding apertures to roll toward frame 4. Openings are provided within frame 4 for allowing access to balls recovered by the inclined planes.

Pitching mechanism 46 is positioned on playing board 2 immediately behind pitcher's mound 14. A release rod 47 extends below playing board 2 for controlling pitching mechanism 46. One end of release rod 47 extends beyond frame 4 and a control knob 48 is attached thereto for remotely operating pitching mechanism 46. The operation of release rod 47 and control knob 48 are explained in further detail below.

Also shown in FIG. 1 proximate home plate 6 are batting positions 50 and 51 corresponding to left handed and right handed batters, respectively. Associated with batting position 50 is a biasing means 52 disposed below playing board 2 for swinging batting member 54 across home plate 6 from a cocked position to a full swing position. A similar biasing means (not shown) is associated with batting position 51. In addition, a bunt control pluger 53 extends from beyond frame 4 behind home plate 6 for effecting a bunt in a manner to be described below.

Figure 2:
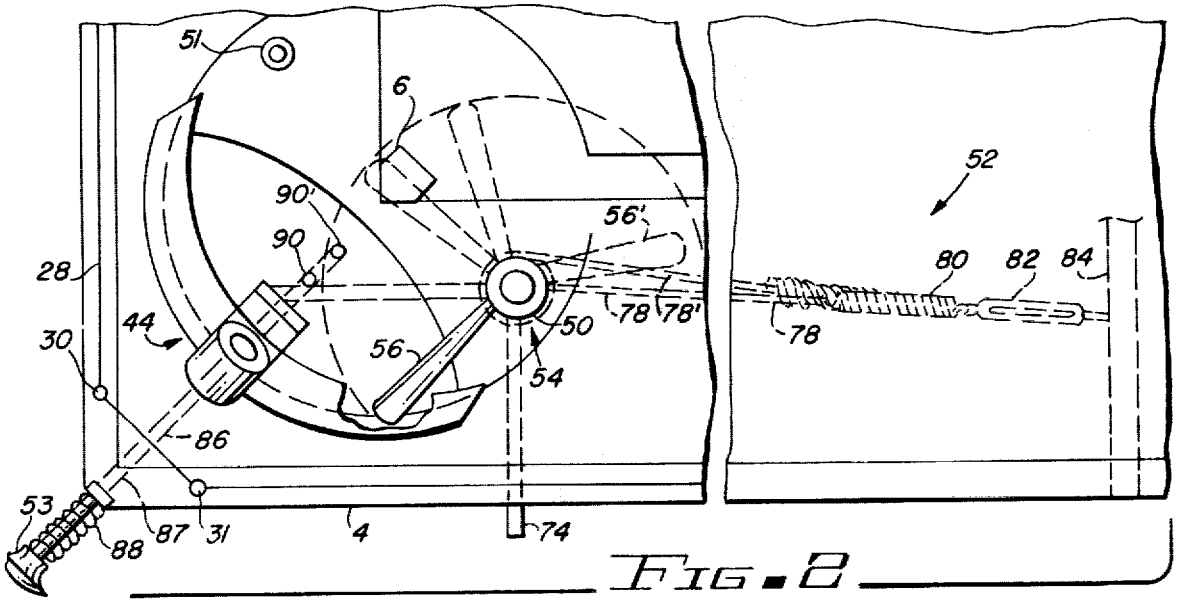
FIG. 2 is an enlarged view of the batting mechanism and bunt control mechanism shown in FIG. 1.

Referring to FIGS. 2–4, batting member 54 includes a horizontally disposed batting arm 56 for hitting pitched balls. Extending from the bottom portion of batting member 54 is a pivot rod 58 having a slot 60 formed in the lower portion thereof. Pin 59 extends through the body of batting member 54 and through pivot rod 58 for rigidly securing pivot rod 58 to the body of batting member 54. Pivot rod 58 may be removably inserted within either batting positions 50 or 51 for simulating left-handed and right-handed batters, respectively.

As shown most clearly in FIG. 3, a rotatable sleeve 62 is disposed within each of the batting positions 50 and 51. Sleeve 62 rotates within a fixed collar 64 secured against the lower portion of the playing board by bolts 65 and nuts 66. A pin 68 is secured within sleeve 62 for removably engaging slot 60 of pivot rod 58. Thus, batting member 54 and sleeve 62 rotate as a unit. Pulley 70 extends around the lower portion of sleeve 62 and is rigidly attached thereto by bolt 72. Bolt 72 also extends through one end of control lever 74, and a nut 76 is tightened over the end of bolt 72. A first end of a cable 78 is inserted through a hole in the lower rim of pulley 70. Knot 79 is formed at the first end of cable 78 to prevent it from slipping back through the hole in pulley 70.

As shown in FIG. 2, the second end of cable 78 opposite the knotted first end is coupled to one end of a spring 80. Turnbuckle 82 couples a second end of spring 80 to a support member 84 attached to the lower side of playing board 2. Adjustment of turnbuckle 82 allows for variation in the tension of spring 80.

To operate batting member 54, a participant inserts pivot rod 58 into either batting position 50 or 51. Assuming, for purposes of example, that batting position 50 is selected, batting member 54 is rotated rearward (counterclockwise in FIG. 2) until control lever 74 extends through an opening formed within frame 4. As shown in FIG. 2, control lever 74 extends in a direction that is offset by an angle of approximately 45° from the direction in which batting arm 56 extends. Therefore, when control lever 74 extends through frame 4, batting arm 56 extends directly away from pitcher's mound 14. As batting member 54 is rotated to the rearward or cocked position, cable 78 winds around pulley 70 and increases the tension on spring 80. As shown in FIG. 2, when batting member 54 is rotated to the cocked position, cable 78 is displaced to the position designated 78'. In order to swing at a pitched ball, a participant operating the batting mechanism simply releases control lever 74. The tension within spring 80 causes batting member 54 to rotate forwardly (clockwise in FIG. 2), thereby swinging batting arm 56 from its cocked position, across home plate 6, and continuing to full swing position 56'. It will be understood by those skilled in the art that a similar pulley, cable, and spring assembly is utilized in conjunction with batting position 51 whereby the participant at bat may operate batting member 54 from either batting position 50 or batting position 51.

Referring now to FIGS. 2 and 5, the baseball game apparatus includes a bunt control rod 86 actuated by plunger 53 for selectively stopping rotation of batting member 54 after a participant has released control lever 74 from its cocked position. Bunt control rod 86 is slidably and rotatably mounted within sleeve 87 of frame 4. The end of bunt control rod 86 opposite plunger handle 53 is bent downwardly to form a hook 90 adapted to engage either control lever 74 of batting position 50 or a similar control lever 74' of batting position 51 (see FIG. 12). Compressible spring 88 is disposed between frame 4 and plunger handle 53 for normally biasing bunt control rod 86 outward and away from home plate 6.

When bunt control rod 86 is biased outward by spring 88, hooked end portion 90 does not extend within the arc traversed by either control lever 74 or control lever 74' upon rotation of batting member 54. Accordingly, batting member 54 can be rotated through a full swing. However, when plunger handle 53 is pushed toward home plate 6, hooked end portion 90 is advanced into the path of control levers 74 and 74' for stopping rotational movement of batting member 54. Hence, batting arm 56 is stopped prior to reaching full swing position 56' in order to effect a bunt. Moreover, the direction of the bunt can be varied depending upon the distance by which plunger handle 53 is advanced. As shown in FIG. 2, hooked end portion 90 may be advanced to dashed position 90' for directing the batted ball further to the right. Similarly, the distance by which plunger handle 53 is advanced may be decreased for directing the batted ball further to the left. In addition, a participant may fake a bunt by simultaneously depressing and rotating plunger handle 53. Rotation of plunger handle 53 and, hence, bunt control rod 86 causes hooked end portion 90 to be moved out of the path of control lever 74 for allowing a full swing of batting arm 56. Moreover, plunger handle 53 may be rotated after hooked end portion 90 has engaged control lever 74 to allow batting arm 56 to follow through to the full swing position after contacting the ball. Thus, the bunt control mechanism of the present invention allows participants to closely simulate bunting as utilized in the actual game of baseball.

The cross-sectional view shown in FIG. 6 of fielding aperture 41 located in center field is exemplary of the other fielding apertures disposed on playing board 2. A circular aperture 92 is formed within playing board 2, and a semi-cylindrical plexiglass deflector 94 extends at an angle through aperture 92 adjacent the rear edge thereof for deflecting batted balls downwardly through aperture 92. Mounting bracket 96 is secured at one end to the lower portion of deflector 94 by fasteners 98. The opposite end of bracket 96 is secured against the lower side of playing board 2 by bolts 100 and 101 and nuts 102 and 103. The end of bolt 101 extends above nut 103 and into cylindrical body of fielder 104. Plexiglass deflector 94 is highly transparent, allowing fielder 104 positioned behind deflector 94 to be clearly viewed from all portions of playing board 2.

The electrical circuit schematic shown in FIG. 7 discloses an optional feature which may be incorporated within the present baseball game apparatus whereby the upper portions of the fielders may be illuminated by two different colored lightbulbs for indicating which of two teams is playing the field at any particular time. Fielder 104 is modified to incorporate a translucent head portion 106 housing a red lightbulb 107 and a blue lightbulb 108. Lightbulbs 107 and 108 each have a first terminal coupled to a common conductor 110 which, in turn, is coupled to a first terminal of an electrical power source 112. The second terminal of power source 112 is coupled to switch contact 114. The second terminal of lightbulb 107 is coupled by conductor 116 to switch contact 118, and the second terminal of lightbulb 108 is coupled by conductor 120 to switch contact 122. When the red team plays the field, switch contact 114 and switch contact 118 are shorted together for illuminating lightbulb 107. On the other hand, when the blue team plays the field, switch contact 114 and switch contact 122 are shorted together for illuminating lightbulb 108. For ease of illustration, only one fielder is shown in FIG. 7. However, it should be clear to those skilled in the art that the red and blue lightbulbs housed within the other fielders may be wired in parallel with lightbulbs 107 and 108 for simultaneously illuminating each of the fielders with the appropriate color.

In FIGS. 8–10, pitching mechanism 46 is shown in greater detail. The pitching mechanism includes a pair of spaced-apart plexiglass panels 124 and 125, the upper edges of which form an inclined slotted track extending through a rectangular aperture 127 within playing board 2. Plexiglass panels 124 and 125 are maintained in spaced apart relationship and are supported by U-shaped brackets 129 and 130. Bracket 129 is disposed between the inner faces of panels 124 and 125 adjacent the front ends thereof. Similarly, bracket 130 is disposed between the inner faces of panels 124 and 125 adjacent the back ends thereof. Bolts, such as those designated 131 and 132 in FIG. 8, extend through panels 124 and 125 and through support brackets 129 and 130, and a nut, such as that designated 133 in FIG. 9, is tightened over the end of bolts 131 and 132 to fasten the assembly together. As shown in FIG. 9, spacers or washers 134 are inserted between bracket 130 and the inner faces of panels 124 and 125 for reasons which will be explained below.

A pair of thin rectangular metal plates 136 and 137 are fastened to brackets 129 and 130 below panels 124 and 125, respectively. Bolts 140 extend through metal plate 136, bracket 130, and metal plate 137, while a nut 141 (see FIG. 9) is threaded over the end of bolt 140. Washers 134 are inserted between bracket 130 and metal plates 136 and 137.

Bracket 129 is in turn attached to a front mounting bracket 144 by fasteners 145. Similarly, bracket 130 is attached to rear mounting bracket 146 by fasteners 147. Front mounting bracket 144 includes a horizontally disposed upper portion which is attached against the lower side of playing board 2 by screws 149 and nuts 150. A plurality of removable shims 151 are inserted between mounting bracket 144 and playing board 2 for adjusting the height of the front ends of panels 124 and 125 above playing board 2. Similarly, rear mounting bracket 146 includes a horizontally disposed upper portion which is attached against the lower side of playing board 2 by screws 153 and nuts 154. Removable shims 155 are inserted between mounting bracket 146 and playing board 2 for adjusting the height of the back ends of panels 124 and 125 with respect to playing board 2. Thus, by varying the number of shims 151 and 155, the height and the degree of incline of the slotted track formed by the upper edges of panels 124 and 125 can be adjusted. As will be apparent below, variation of the height and degree of incline of the slotted track will, in turn, result in variation of the trajectory of a ball pitched therefrom.

Still referring to FIGS. 8–10, a U-shaped pivot member 158 is pivotally mounted between metal plates 136 and 137 by bolt 160 and nut 161. Pivot member 158 may be of the same width as brackets 129 and 130 since washers 134 maintain the distance between panels 124 and 125 and the distance between metal plates 136 and 137 is in excess of the width of brackets 129 and 130. The upper end of pivot member 158 extends between panels 124 and 125.

Spring 162 is utilized to urge pivot member 158 from the back end of panels 124 and 125 to the front ends thereof. A first end of spring 162 engages looped end portion 163 of bolt 164. Bolt 164 extends through a hole within pivot member 158 and is engaged by a wing nut 165. The opposite end of spring 162 engages looped end portion 168 of bolt 169. The end of bolt 169 threadedly engages a turnbuckle 170 secured to the lower portion of front mounting bracket 144 by screw 171 and nut 172. It will be clear to those skilled in the art that the tension on spring 162 and, hence the force with which pivot member 158 is urged forward, can be varied by adjusting wing nut 165 and/or by turning bolt 169 within turnbuckle 170. Spring 162 may be easily replaced when necessary as the ends thereof simply loop over hooked end portions 163 and 168 of bolts 164 and 169, respectively.

As shown in FIGS. 8–10, a pitching arm 174 has a slot 176 formed in the lower portion thereof for engaging the upper portion of pivot member 158. Pitching arm 174 is used to propel ball 175, which is preferably a ping pong ball, toward home plate in a lofted trajectory above playing board 2. A rubber bumper 182 is positioned between panels 124 and 125 proximate the upper front portions thereof for cushioning pitching arm 174 after pivot member 158 is released. The front face of pitching arm 174 may include a plurality of variously angled surfaces for controlling the trajectory of the pitched ball. For example, as shown in FIG. 8, pitching arm 174 includes a first flat surface 177 at the lower portion of the front face thereof for pitching a relatively straight fast ball. Immediately above flat surface 177 is an angled surface 178 for curving the pitched ball to the left side of home plate as viewed from behind home plate. Immediately above angled surface 178 is an oppositely angled surface 179 for curving the pitched ball to the right side of home plate as viewed from behind home plate. Finally, a second flat surface 180 is formed above angled surface 179 for pitching a relatively straight, slow ball.

The actual trajectory of a pitched ball depends upon which of the plurality of surfaces formed along the front face of pitching arm 174 contacts ball 175 at the instant that pivot member 158 is accelerated forward by spring 162. For example, ball 175 will be pitched as a relatively straight fast ball provided that pivot member 158 is released when ball 175 is in contact with flat surface 177. In this instance, the full force of spring 162 is used to accelerate pivot member 158; hence, the ball is pitched relatively fast. On the other hand, a relatively slow right-curving pitch (as viewed from behind home plate) will be delivered if angled surface 179 contacts ball 175 when pivot member 158 is released. In this event, pivot member 158 and pitching arm 174 are advanced to the dashed line positions referenced 158' and 174' prior to releasing pivot member 158. Thus, the full force of spring 162 is not imparted to pivot member 158, and a relatively slower pitch results.

As set forth above with regard to FIG. 1, a release rod 47 is disposed beneath playing board 2 and is controlled by knob 48 for operating pitching mechanism 46. As shown in FIGS. 8 and 9, release rod 47 is slidably supported by channel member 184 below playing board 2. The end of release rod 47 opposite knob 48 is bent to form a catch 185 for controlling the point at which pivot member 158 is released. Catch 185 includes a first portion 186 extending radially from release rod 47 and a second portion 187 extending from portion 186 parallel to release rod 47. A portion of panel 124 is cut away for allowing catch 185 to access pivot member 158, as shown in FIG. 8.

As shown best in FIG. 10, portion 187 of release rod 47 engages the front face of pivot member 158 for restraining it against the biasing action of spring 162. Pivot member 158 is released by pulling outward on control knob 48, thereby causing catch 185 of release rod 47 to move to the dashed line position shown in FIG. 10. A stop bracket 188 has a first end secured to the outer face of panel 124 by bolt 190 and nut 191, and the second end of stop bracket 188 is secured against the outer face of metal plate 136 by bolts 192. When control knob 148 is pulled outward to release pivot member 158, portion 186 of release rod 47 engages stop bracket 188 for preventing release rod 47 from being pulled outward excessively.

In order to pitch a ball, the participant operating pitching mechanism 46 manipulates control knob 48 to engage catch 185 with the front face of pitching member 158. Control knob 48 is then rotated to turn release rod 47 clockwise (see FIG. 8) for moving pivot member 158 and pitching arm 174 rearward against the biasing action of spring 162. Ball 175 is then placed upon the inclined slotted track formed by the upper edges of panels 124 and 125. If it is desired to pitch a straight fast ball, control knob 48 may then be immediately pulled outward for releasing pivot member 158 while flat surface 177 of pitching arm 174 contacts ball 175. On the other hand, if it is desired to pitch a ball which curves to the right of home plate (as viewed from behind home plate), then the participant rotates control knob 48 counterclockwise until angled surface 179 is in contact with ball 175, as shown by the dashed lines 174' and 175' in FIG. 8. Control knob 48 is then pulled outward for releasing pivot member 158 so that it may be accelerated under the action of spring 162. Thus, the pitching mechanism of the present invention operates to pitch the ball in a lofted trajectory above the playing board while allowing for a variety of pitches having different speeds and directions as determined by the variously angled surfaces formed upon the front face of the pitching arm 174. Furthermore, the mechanism for controlling the release and the trajectoty of pitched balls is simple to operate and is for the most part out of sight below playing board 2.

Figure 11A:
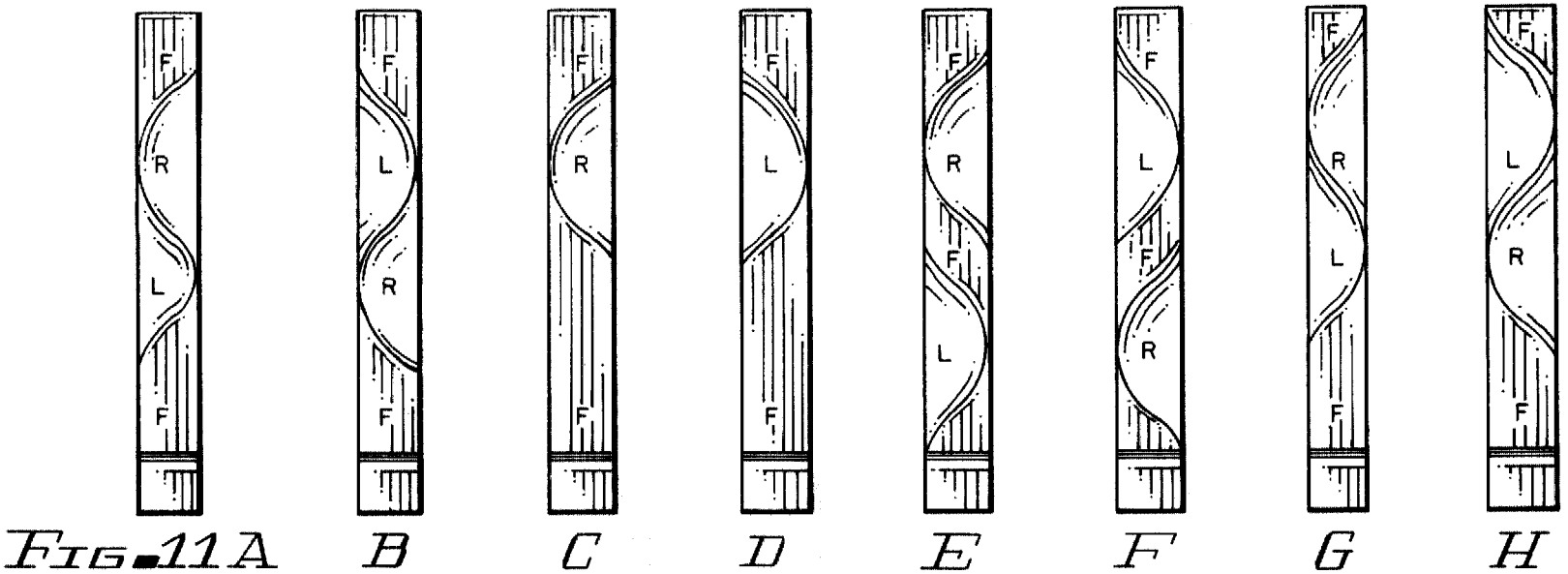
FIGS. 11A-11P illustrate various removable pitching arms for use in conjunction with the pitching mechanism shown in FIGS. 8-10.
Figure 11:
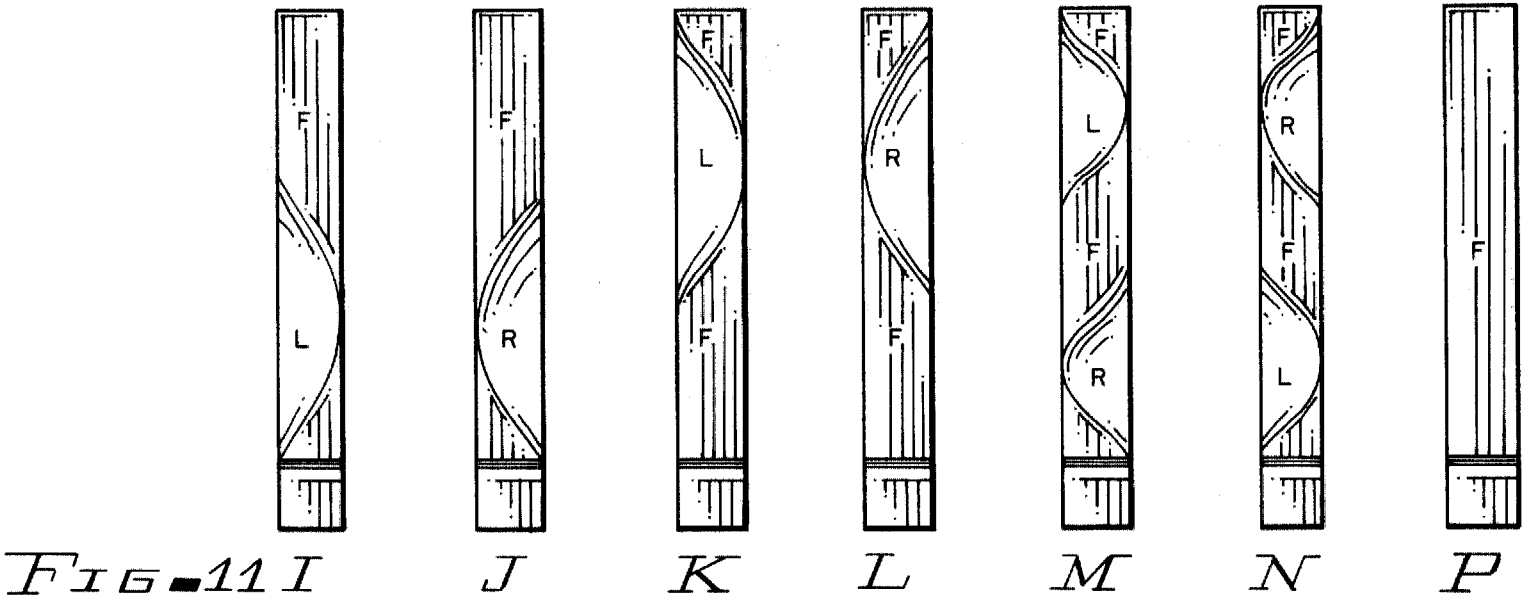

To further increase the versatility of pitching mechanism 46, a plurality of interchangeable pitching arms may be provided for use in conjunction with pivot member 158. FIGS. 11A–11P illustrate some of the possible configurations of pitching arm surfaces which may be utilized. Each of the interchangeable pitching arms includes a slot in the lower portion thereof for removably engaging the upper portion of pivot member 158. Within FIGS. 11A–11P, the designation F indicates a flat surface for throwing a relatively straight pitch, the designation R designates an angled surface for curving a pitched ball to the right of home plate (as viewed from behind home plate) and the designation L indicates an angled surface for curving a pitched ball to the left of home plate (as viewed from behind home plate).

Providing a plurality of interchangeable pitching arms allows participants to select from a "bullpen" of pitchers each having different pitching characteristics. For example, the participant operating pitching mechanism 46 may elect to insert a different pitching arm when a left-handed batter is up at bat. Moreover, the ability to interchange pitching arms allows the pitching mechanism to be easily and conveniently adapted to the level of skill of each participant. For example, a beginner could select a pitching arm having an entirely flat surface (see FIG. 11P) or a pitching arm with one flat and one curved surface (see FIG. 11I, 11J) since these pitching arms do not require a high degree of precision in regard to controlling the point of release. On the other hand, a participant experienced in utilizing the present pitching mechanism may select from among more complex pitching arms for delivering a wider variety of pitches. As the number of differently angled surfaces formed upon a pitching arm is increased, the chance that a participant will make a mistake is also increased. For example, a participant may intend to utilize one of the angled surfaces to deliver a curving pitch but instead contact the ball with the ridge separating two adjacent angled surfaces and thereby deliver a straight ball instead. Such errors simulate those mistakes made in the actual game of baseball when, for example, a pitcher intends to throw a curve but does not snap his wrist properly. It may be desirable to include several wooden blanks for use in conjunction with the present baseball game apparatus in order to allow the user to contour one or more pitching arms from the wooden blanks according to his particular liking.

Figure 12:
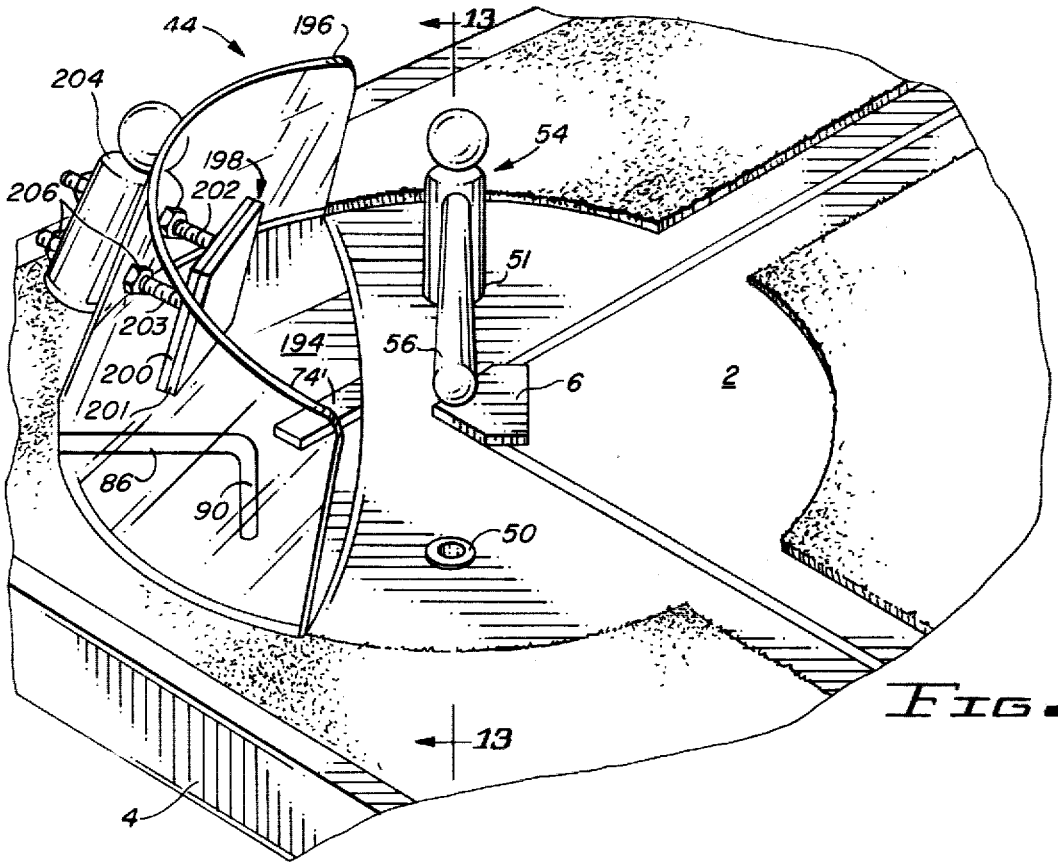
FIG. 12 is a perspective view of the area adjacent home plate and illustrating a strike zone deflector constructed according to the teachings of the present invention.
Figure 13:
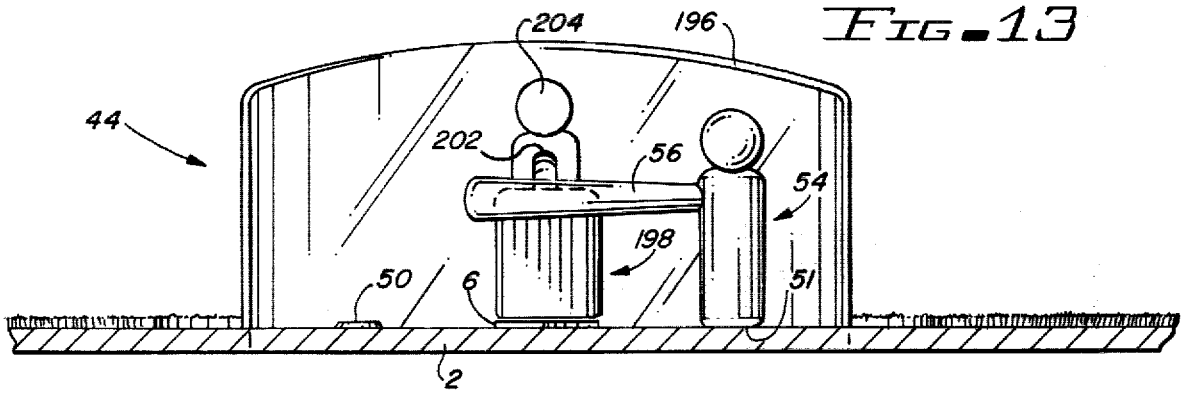
FIG. 13 is a frontal view of the strike zone deflector shown in FIG. 12.

Referring now to FIGS. 12 and 13, catcher 44 is described in further detail. Semicircular aperture 194 is formed within playing board 2 immediately behind home plate 6. Semicylindrical plexiglass shield 196 extends through aperture 194 proximate the rear edge thereof for deflecting pitched balls through aperture 194. Shield 196 may be attached to the underside of playing board 2 in a manner similar to that shown in FIG. 6. A strike zone deflector, designated generally by reference numeral 198, extends in front of shield 196, behind home plate 6, and above aperture 194. Both shield 196 and strike zone deflector 198 are disposed at an angle for deflecting pitched balls through aperture 194 to a common retrieval point. The width of strike zone deflector 198 is commensurate with the width of home plate 6; the length of strike zone deflector 198 is selected such that only those pitched balls which have passed within the hitting range or strike zone of batting member 54 impact the strike zone deflector. As will be apparent to those skilled in the art, a pitched ball tends to fall or drop as it travels between the point at which home plate 6 is located and the point at which strike zone deflector 198 is positioned. Accordingly, strike zone deflector 198 is disposed lower than the actual hitting range of batting member 54 to compensate for this dropping of the ball.

As shown in FIG. 12, strike zone deflector 198 is preferably constructed from a thin layer of fiberboard, the front side of which is covered by a thin layer of foam rubber 201 for dampening the motion of pitched balls which impact strike zone deflector 198. Strike zone deflector 198 is supported by a pair of bolts 202 and 203 which extend rearwardly from fiberboard layer 200 through holes provided in shield 196, and continuing through cylindrically shaped catcher body 204. Nuts, such as those designated by 206 in FIG. 12, are threaded over bolts 202 and 203 immediately in front of shield 196 and immediately behind catcher body 204 for rigidly securing strike zone deflector 198 and cylindrical body 204 to shield 196.

In playing the game, one participant operates the pitching mechanism while his opponent operates the batting mechanism. The rules of play are identical to those of the actual game of baseball. Pitched balls and strikes are called in accordance with whether or not a pitched ball impacts strike zone deflector 198. A pitched ball which passes to the side of or above shield 196 is counted as a wild pitch, in which event the batter advances to first base and each base runner advances one base. Should a pitched ball impact strike zone deflector 198 and rebound back onto playing board 2 with two strikes already counting against the batter, then the pitch is counted as a drop-third strike, and the batter reaches first base. A balk is scored if the ball does not leave the inclined slotted track of the pitching mechanism after the control knob is released.

When the ball is batted, the rules as to fair and foul territory apply. If the ball is batted into fair territory and is neither deflected into an infield fielding aperture (34–38) by direct flight or by rolling nor deflected into an outfield fielding aperture (40–42) by direct flight, then the batter is credited with a hit. A batted ball which clears the outfield fence in fair territory is counted as a home run. A batted ball which passes above fielding aperture 41 in center field without clearing the outfield fence is counted as a triple (or three-base hit). A batted ball which hits the outfield fence on a fly but does not pass above fielding aperture 41 is counted as a double (or two-base hit); a batted ball which boundes on the playing board in fair territory and then leaves the playing board is also counted as a double. All other hits are counted as a single (or one-base hit).

A hit on error is scored if a batted ball strikes one of the fielding apertures but is not retained thereby. A batter is awarded one base if the error is committed by an infielder, two bases if the error is committed by the right fielder or left fielder, and three bases if the error is committed by the center fielder.

When runners are on base, they are advanced in accordance with the number of bases reached by subsequent batters. When a ball is batted directly into one of the outfield fielding apertures (40–42), the batter is out and none of the base runners advance, except that a runner on third base safely reaches home in the event that the ball is batted into fielding aperture 41 in center field. If no runners are on base, a ball batted to an infielder results in the batter being out at first base. With a runner on first base only, a double play is scored if the ball is batted to either the second baseman (35) or shortstop (36); if the pitcher (14), first baseman (34), or third baseman (37) catch the ball, then the runner is out and the batter reaches first base. With a runner on second base only, a ball caught by infielders 34–36 retires the batter and advances the runner to third base; a ball caught by the pitcher (14) holds the runner at second base and retires the batter, and a ball caught by the third baseman (37) retires the runner while allowing the batter to reach first base. With a runner on third base only, a ball caught by any infielder retires the batter and holds the runner at third base.

With runners on first and second base only, a ball batted to the pitcher or third baseman results in the runner at second being out at third base; a ball batted to any of the other infielders advances the runners one base and results in the batter being out. With runners on first and third bases only, the batter and runner on first base are both out and the runner on third base scores home provided that the ball is caught by either the second baseman or shortstop; if the pitcher or first baseman catches the ball, then the batter is out, the runner on first reaches second base, and the runner on third holds; if the third baseman catches the ball, then the batter reaches first base, the runner on first base is out at second base, and the runner on third base holds.

With runners on second and third bases only, the batter is out and the runners advance one base provided that the ball is caught by the second baseman or shortstop; if either the pitcher or first baseman catches the ball, then the batter is out and the runners hold their bases; if the third baseman catches the ball, then the runner at third is out at home plate while the batter takes first base and the runner on second base advances to third base.

Finally, with bases loaded, the batter is out, the runner on first is out at second base, and the runners on second and third bases each advance one base provided that the ball is caught by either the second baseman or shortstop; if the ball is caught by any of the other infielders, then the batter is out, the runner on third is out at home plate, and the runners on first and second bases advance one base.

Thus, the baseball game apparatus of the present invention simulates the actual game of baseball as nearly as possible. While the invention has been described with reference to a preferred embodiment thereof, the description is for illustrative purposes only and is not to be construed as limiting the scope of the invention. Various modifications and changes may be made by those skilled in the art without departing from the true spirit and scope of the invention as defined by the appended claims.

I claim:

1. A baseball game apparatus comprising in combination:

a. a playing board including indicia designating home plate and designating a pitcher's mound;

b. an inclined, slotted track extending above said playing board proximate said indicia designating said pitcher's mound for receiving a ball to be pitched, said slotted track having front and back ends, said front end being higher than said back end;

c. a pivotally mounted pitching member movable within said slotted track; and d. biasing means for urging said pitching member toward the front end of said slotted track for pitching the ball in a continuous, lofted trajectory above said playing board from a point proximate said pitcher's mound to a point relatively proximate home plate.

2. A baseball game apparatus as recited in claim 1 wherein said biasing means includes a spring coupled to said pitching member.

3. A baseball game apparatus as recited in claim 2 wherein said biasing means further includes means for adjusting the tension of said spring in order to vary the speed of a pitched ball.

4. A baseball game apparatus as recited in claims 1 or 3 including adjustment means for adjusting the degree of inclination of said inclined slotted track relative to said playing board in order to vary the trajectory of a pitched ball.

5. A baseball game apparatus as recited in claim 1 further including manually operated control means for controlling the position of said pitching member relative to said inclined slotted track prior to releasing said pitching member under the action of said biasing means.

6. A baseball game apparatus as recited in claim 1 wherein said pitching member includes a plurality of surfaces for contacting the ball and propelling it forward, at least two of said plurality of surfaces being disposed at different angles from one another for varying the trajectory of the pitched ball.

7. A baseball game apparatus as recited in claim 1 wherein said pitching member includes a plurality of surfaces for contacting the ball and propelling it forward when said pitching member is released from a corresponding plurality of different positions relative to said inclined slotted track, said baseball game apparatus further including means for releasing said pitching arm from said corresponding plurality of different positions.

8. A baseball game apparatus as recited in claim 1 wherein said pitching member includes a lower portion mounted for pivotal movement and coupled to said biasing means, said pitching member further including first and second upper portions each removable and interchangeably engaging said lower portion for pivotal movement therewith within said inclined slotted track, each of said first and second upper portions pitching the ball when said lower portion moves forward under the action of said biasing means, said first and second upper portions including at least first and second surfaces, respectively, for contacting the ball and propelling it forward, said first and second surfaces differing in orientation from one another for allowing the trajectory of a pitched ball to be varied by interchanging said first and second upper portions.

* * * * *